US005255864A

United States Patent [19]

Lahaussois

[11] Patent Number: 5,255,864

[45] Date of Patent: Oct. 26, 1993

[54] MULTI-FUNCTIONAL CORE FOR TOILET TISSUE OR THE LIKE

[76] Inventor: Pierre Lahaussois, 25-13 Old Kings Hwy. North, Darien, Conn. 06820

[21] Appl. No.: 963,653

[22] Filed: Oct. 20, 1992

[51] Int. Cl.[5] ..... B65H 75/02

[52] U.S. Cl. ..... 242/68.5; 242/1; 220/666

[58] Field of Search ..... 242/68.5, 68.6, 55.2, 242/1; 220/666, 667

[56] References Cited

U.S. PATENT DOCUMENTS 3,354,924 11/1967 Birrell et al. ..... 220/666

4,147,279 4/1979 Matsui ..... 220/666

*Primary Examiner*—Daniel P. Stodola

*Assistant Examiner*—John Q. Nguyen

*Attorney, Agent, or Firm*—Schweitzer Cornman & Cross

[57] ABSTRACT

A core sleeve for a roll of toilet tissue is provided with longitudinal and arcuate fold lines. After the toilet tissue has been removed from the core sleeve, the core sleeve is folded along the fold lines to reform the core sleeve into a disposable pouch.

4 Claims, 2 Drawing Sheets

MULTI-FUNCTIONAL CORE FOR TOILET TISSUE OR THE LIKE

BACKGROUND AND SUMMARY OF THE INVENTION

The invention is directed to a novel and improved core sleeve for toilet tissue, and perhaps other household paper products, which is designed and constructed to have secondary utility. Typically, toilet tissue sold for household use is provided in rolls, wound upon a hollow core sleeve formed of a paperboard material. When the roll is exhausted, the core sleeve is simply discarded. Pursuant to the present invention, however, the core sleeve is constructed in a manner to accommodate secondary utilization as a convenience device, for example, as a one-way travel pouch or the like.

Pursuant to the invention, a core sleeve for toilet tissue or the like is provided with longitudinal score lines extending along diametrically opposed lines of the core sleeve enabling the sleeve, after the tissue has been entirely removed therefrom, to be compressed and partially flattened over its full length to form a hollow tube having a cross section generally in the form of two opposed arcs joined along the opposed longitudinal score lines. At each end, the core sleeve is formed with a pair of arcuate fold lines, each intersecting with the opposed longitudinal fold lines, substantially at the end extremity of the sleeve. These arcuate fold lines define generally crescent shaped, integral end flaps adapted to be folded inwardly to form opposed, concave end closures at each end of the partially flattened hollow sleeve.

Pursuant to the invention, after the core sleeve has served its original and primary function, it is re-formed into a disposable pouch which can be usefully employed as a travel convenience item, for example.

For a more complete understanding of the above and other features and advantages of the invention, reference should be made to the following detailed description of a preferred embodiment of the invention and to the accompanying drawings.

DESCRIPTION OF A PREFERRED EMBODIMENT OF THE INVENTION

Figure 1:
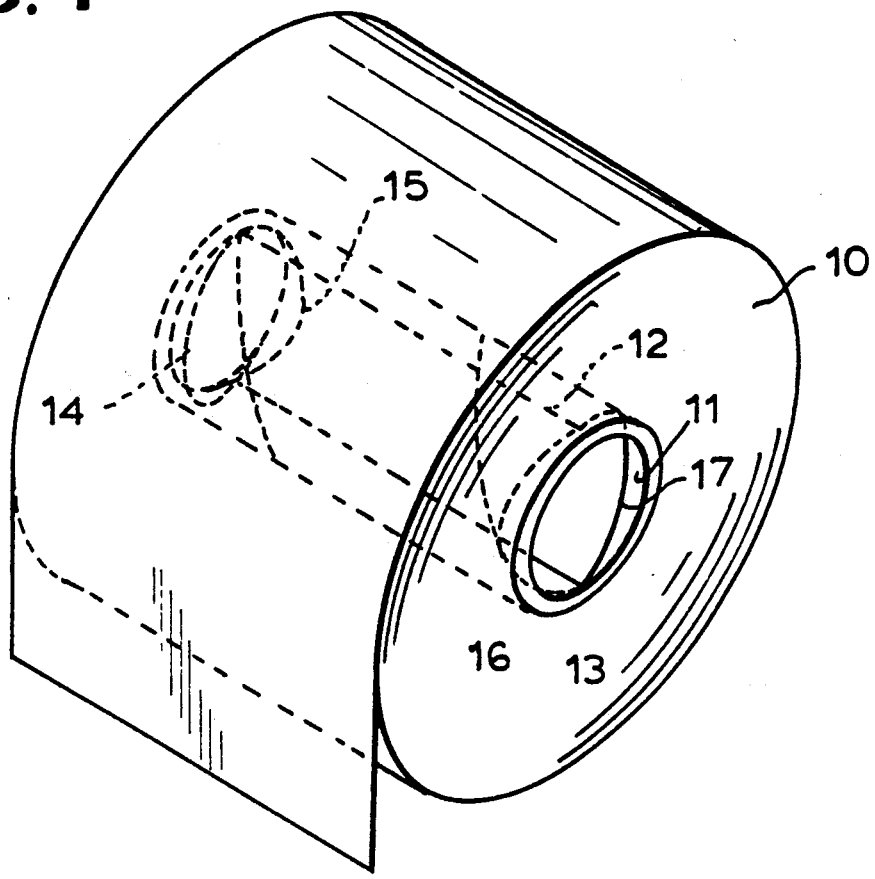
FIG. 1 is a perspective view of a toilet tissue roll incorporating a core sleeve according to the invention.

Referring now to the drawing, the reference numeral 10 designates generally an otherwise conventional roll of household toilet tissue, conventionally wound upon a central hollow cylindrical core sleeve 11. Typically, the core sleeve is formed of paperboard material, for example, in two or more spirally wound layers of heavy paper.

Figure 2:
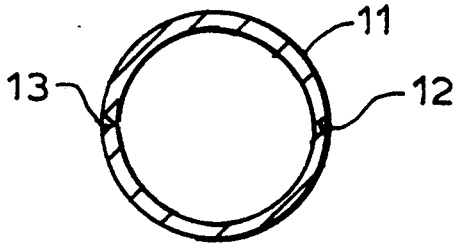
FIGS. 2 and 3 are cross sectional views of the core sleeve, respectively in its original cylindrical form and in its reconfigured, partially flattened form.

In accordance with the invention, the core sleeve, during the initial manufacturing phase, is provided with longitudinally extending score lines 12, 13, extending the full length of the core sleeve at diametrically opposed areas, as reflected in FIG. 2. At its opposite ends, the core sleeve is provided with arcuate score lines 14, 15, at one end, and 16, 17 at the opposite end. Each of the arcuate score lines intersects at its opposite ends with the end extremities of the respective longitudinal score lines 12, 13.

Figure 3:
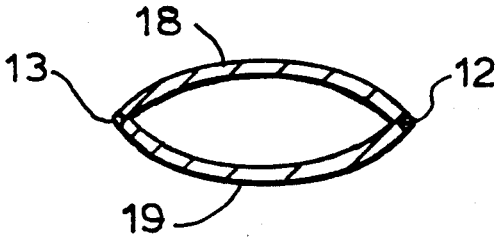
Figure 4:
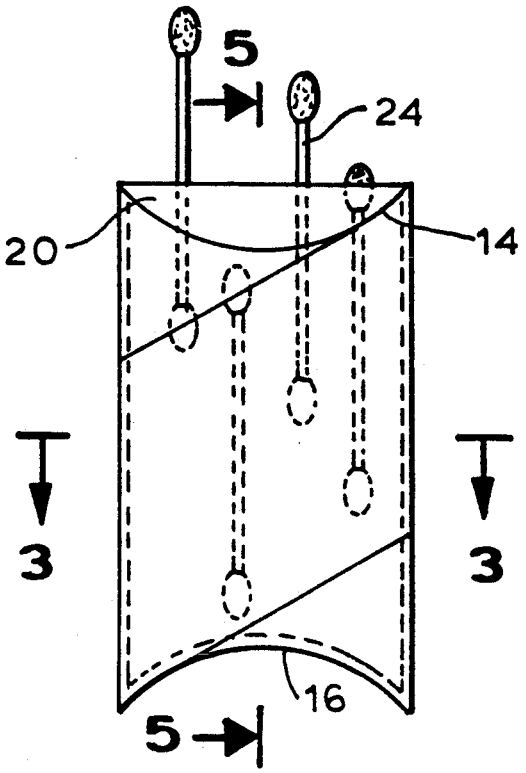
FIG. 4 is a front elevational view of the device of the invention, configured to form a disposable pouch, shown open at the top and closed at the bottom.
Figure 5:
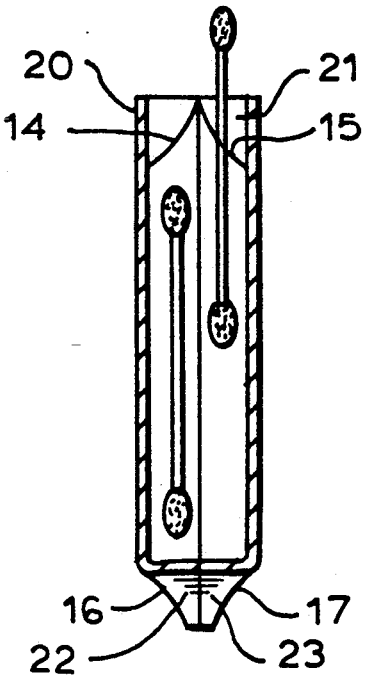
FIG. 5 is a cross sectional view as taken generally on line 5—5 of FIG. 4.

When the tissue roll 10 is completely exhausted, and the core sleeve 11 is exposed, it may be converted to a disposable pouch by first partially flattening the sleeve from its initial, cylindrical form, shown in FIG. 2, to a form shown in FIG. 3. The opposed longitudinal score lines 12, 13 facilitate this partial flattening, which results in a cross sectional configuration generally in the form of opposed arcuate panels 18, 19, joined at their edges along the score lines 12, 13.

The end score lines 14–17, as shown in FIGS. 4–7, are of equal radius, which radius is substantially greater than that of the core sleeve in its initial, cylindrical form. By way of example only, whereas the initial radius of the cylindrical core sleeve may be approximately 0.9 inch, the radius of the arcs 14–17 preferably is on the order of two inches. The arcuate score lines form crescent shaped flaps 20, 21, at one end of the core sleeve, and 22, 23 at the opposite end.

After the core sleeve has been partially flattened, to the form shown in FIG. 3, the crescent shaped flaps at one end of the sleeve, for example the flaps 22, 23 at the "bottom" end as illustrated in FIGS. 4–7, are folded inwardly to form opposed, concave end closures. Because of the compound curvature of the score lines 16, 17, the closure flaps 22, 23 tend to be self-holding in their closed positions, as illustrated in FIGS. 4–7.

At the opposite end of the reconfigured sleeve, the still-open end flaps 20, 21 provide access to the top of the pouch, enabling it to be loaded with desired contents. By way of example only, a core sleeve for a standard roll of household toilet issue is of an appropriate size to receive a supply of cotton tipped swabs 24, although the pouch is obviously suitable to receive small articles of any description.

Figure 6:
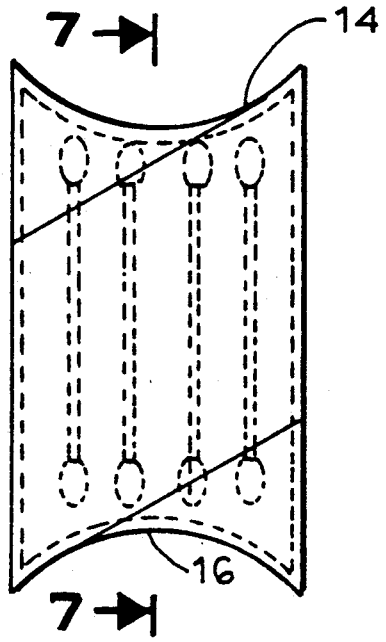
FIG. 6 is an elevational view, similar to FIG. 4, showing the pouch closed at both top and bottom.
Figure 7:
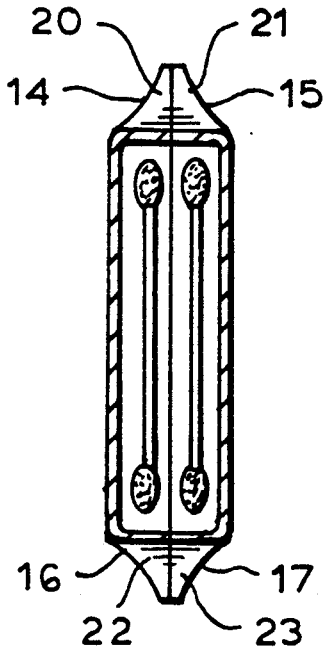
FIG. 7 is a cross sectional view as taken generally on line 7—7 of FIG. 6.

After the desired contents are loaded into the pouch, the closure flaps 20, 21 at the upper end are folded inwardly to close positions, shown in FIGS. 6 and 7 of the drawing.

The device of the invention is a highly convenient and useful disposable pouch device conveniently usable for travel or other purposes and provides at insignificant cost a means for achieving a further utilization of an item which is otherwise simply discarded.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A hollow core for toilet tissue, which comprises (a) a hollow, thin-walled cylinder of finite length and of a flexible material, (b) said cylinder having longitudinal fold lines therein exdending over the full length of the cylinder along two diametrically opposed lines, enabling said cylinder to be compressed and partially flattened to form a hollow tube having a cross section generally in the form of two opposed arcs, joined along said longitudinal fold lines, (c) said cylinder further having, at each end thereof, a pair of arcuate fold lines, each intersecting with said opposed longitudinal fold lines substantially at an end of said cylinder, (d) said arcuate fold lines defining generally crescent shaped integral end flaps adapted to be folded inwardly to form opposed concave end closures at each end of the partially flattened hollow tube.

2. A hollow core according to claim 1, further characterized by (a) said cylinder being formed of paperboard material.

3. A hollow core according to claim 1, further characterized by (a) said arcuate fold lines being generally formed on a radius greater than the radius of said cylinder.

4. A roll of toilet tissue wound on a hollow core, said hollow core comprises:

(a) a hollow, a thin-walled cylinder of finite length and of a flexible material, (b) said cylinder having longitudinal fold lines therein extending over the full length of the cylinder along two diametrically opposed lines, enabling said cylinder to be compressed and partially flattened to form a hollow tube having a cross section generally in the form of two opposed arcs, joined along said longitudinal fold lines, (c) said cylinder further having, at each end thereof, a pair of arcuate fold lines, each intersecting with said opposed longitudinal fold lines substantially at an end of said cylinder, (d) said arcuate fold lines defining generally crescent shaped integral end flaps adapted to be folded inwardly to form opposed concave end closures at each end of the partially flattened hollow tube.

* * * * *